US006272781B1

(12) United States Patent
Resnick

(10) Patent No.: US 6,272,781 B1
(45) Date of Patent: Aug. 14, 2001

(54) CLOSE-CONTACT COUNTER-MEASURE GARMENT AND METHOD

(76) Inventor: Joseph Anthony Resnick, 206 Freedom La., Natrona Heights, PA (US) 15065

( * ) Notice: Subject to any disclaimer, the term of this patent is extended or adjusted under 35 U.S.C. 154(b) by 0 days.

(21) Appl. No.: 09/312,535

(22) Filed: May 24, 1999

(51) Int. Cl.[7] ..... F41C 9/00

(52) U.S. Cl. ..... 42/1.11; 42/1.09; 89/1.11; 89/1.1; 89/36.05; 2/2.5; 224/262

(58) Field of Search ..... 42/1.11, 1.09; 89/1.11, 1.1, 36.05; 2/5, 2.5; 224/262

(56) References Cited

U.S. PATENT DOCUMENTS

| | | | | |
|---|---|---|---|---|
| 1,866,048 | * | 7/1932 | Marine | 42/1.11 |
| 2,102,568 | * | 12/1937 | Elkins | 42/1.11 |
| 2,381,547 | * | 8/1945 | Leininger | 42/1.11 |
| 5,831,198 | * | 11/1998 | Turley | 89/1.11 |
| 5,996,115 | * | 12/1999 | Mazelsky | 89/36.05 |

FOREIGN PATENT DOCUMENTS

450637 * 8/1948 (CA) .

OTHER PUBLICATIONS

Prabhat Chemical Co. http:/www.bicserve.com/htm/prabhat3.htm.

Non–Lethal Weapons for Military Operations Other than War. By: Cadet First Class Joseph M. Suhaida Apr. 14, 1999, 9 pps.

* cited by examiner

*Primary Examiner*—J. Woodrow Eldred

(57) ABSTRACT

A garment equipped with emitter, said emitter positioned on the garment such that the emitter can be a weapon, where said emitter can be fired by the wearer of the garment or fired remotely by a second person, an observer, or a third person, a monitor, an observer who is monitoring, where said emitter emits a means to mark an attacker by marking means, the position, identification of, and, alternatively, to immobilize or interfere with an attacker of the wearer of the garment. A method of defending an individual, including wearing by the individual a garment having contained upon, in, or proximal thereto a lethal, non-lethal, or less-than lethal weapon, and discharging or firing the weapon from the garment in the direction of an attacker.

29 Claims, 6 Drawing Sheets

CLOSE-CONTACT COUNTER-MEASURE GARMENT AND METHOD

TECHNICAL FIELD

The instant invention relates to novel garments and methods for counter-measuring an assault or attack by an actor when such assault or attack takes place face-to-face, or hand-to-hand, and/or when the wearer of this invention is not expecting or anticipating such assault or the wearer is unable to defend against said assault or attack.

BACKGROUND ART

Prior to reducing the invention to practice I undertook a search of the current literature via the IBM Patent Server which is available on the World Wide Web at ht.// www.IBMPatentServer.com and several search engines, such as "Infoseek" and "Yahoo". These data bases afford access to relevant fields, subjects and patents related to the user's interest. It should be noted that said search was limited to the most recent patents issued over the past 20 years. Using the Boolean technique at the IBM Patent Server, I was able to identify seven (7) patent references to vest-type garments. These are, i) U.S. Pat. No. 05,620,277, Issued in 1997, Titled, Vest Garment with Pivotal Seat Member; ii) U.S. Pat. No. 04,637,076, Issued 1987, Titled, Convertible vest-bag; iii) U.S. Pat. No. 04,827,534, Issued in 1989, Titled, Sun-powered vest; iv) U.S. Pat. No. 04,472,835, Issued in 1984, Titled, Reversible thermal vest garment; v) U.S. Pat. No. 04,261,059, Issued in 1981, Titled, Inclement environment jacket and vest garment; vi) U.S. Pat. No. 05,512,348, Issued in 1996, Titled, Armor with breakaway sewing; and finally, vii) U.S. Pat. No. 05,289,959, Issued in 1994, Titled, Infant Rescue Vest.

I performed several other searches on other data bases in a effort to determine whether my invention might be similar to prior art. I was unable to find any references in any data bases regarding "counter-measure garments" or "counter-counter-measure protective garments", or "interactive protective garments". It is noted that the above references deal with garments which either protect the wearer from weather conditions, or from injuries during sporting activities, or used as a supplemental battery charger as in the case of U.S. Pat. No. 04,827,534. None of the cited references teach counter-measure of the assault of an attacker, or anticipate a potential threat by an attacker (with exception of bullet-proof vest), and none of the references teach ejection of projectiles or non-lethal means being incorporated in and used in conjunction with a wearable garment or vest, any of which being capable of thwarting an attack by an actor or protecting the wearer from fatal injury or death with either lethal or less-than-lethal technologies.

In an additional search of the literature I was able to identify a number of different non-lethal technologies. These are now referred to as "LTL's", or, "Less-Than-Lethal Technologies". An excellent description of these technologies can be found at http://www.usafa.af.mil/wing/34edg/airman/suhajd~1.htm on the World Wide Web. This is a nine-page document, included herewith as an exhibit. This document was authored by Cadet First Class Joseph M. Suhajda. The article discusses various types of LTL's such as Stun Guns; Flash-Bangs; Plastic Bullets; Bean-Bag Bullets; Pepper Bombs; CS (tear) Gas; "E-Z-4" (a sleeping gas); Xenon-Strobe light (high intensity light which causes temporary blindness); nets; sticky foam; super lubricants; Super Foam (less stick, but immobilizes); and finally, Radio Frequency ("RF") Weapons. A potent RF weapon is a high powered very low frequency ("VLF") modulator that operates in the 20–35 Khz spectrum. This device emits an "acoustic bullet" which can be modulated to cause slight to severe physical discomfort.

A demonstration of a number of LTL's was presented by the DOD under the supervision of the U.S. Marine Development Command at Quantico, Va. on May 3–5, 1999 in conjunction with the University of New Hampshire's Special Projects Division. I attended the three-day seminar in order to better familiarize myself with LTL technologies.

DISCLOSURE OF INVENTION

Since the early 1970's more and more women have entered the public service sector, more specifically, more women have become police officers. Perhaps this class of public servants, more than any other, for example, utility meter readers or animal control officers, etc., are at greater risk of being injured seriously or killed on the job as a result of attacks by actors or criminals. That is why the advancement and production and use of the new garment device, such as is proposed, is propitious.

On Nov. 20, 1998, I watched a television program called the "Maury Povich Show", which aired on WTAE TV CHANNEL 4 Pittsburgh Pa. at 10:00 O'clock A.M. During that show a female police officer from the State of Texas was a guest. A videotape was shown where this female officer, who weighed approximately 110 pounds, was assaulted by an actor who weighed more than three times her weight. This attack took place during a routine stop by the female police officer and was recorded on the police car's video camera unit. The attack was completely by surprise. Before the officer could respond or draw her weapon or take any kind of defensive action, the actor had punched her in the face, wherein she lost consciousness and fell backward to the ground, at which point the attacker jumped on top of her abdomen and began delivering additional blows to her face and head. The female office was nearly beaten to death. I watched in horror as the attacker beat the officer viciously and mercilessly. After viewing that horrible footage, and considering my prior work with discrete, electronic systems, I conceptualized the following invention which I now hereby teach.

The instant invention now provides a variety of novel means and methods for rendering an attacker harmless in a non-lethal or less-than-lethal manner, by way or employment of an emitter means, a launcher, for example, on a garment in the event that i) the wearer is attacked by surprise; or ii) the wearer's hands are not free during the attack in which case the invention can be operated in an "automatic" mode via one or a plurality of telemetry means and electronic systems, or iii) the wearer decides to use the instant invention as an augment to his/her physical attributes during an assault or an arrest. Such novel means and methods include use of radio signals and/or switching means, active and/or passive, to control electro-mechanical systems contained within the garment, such as emitters and switches in combination, and/or such as video monitoring systems, or dispelling of gasses or projectiles or liquids or change of state chemicals from the garment toward the direction of the actor or would-be actor, or by ejection of of active restraint mechanisms released by emitter or launchers, such as nets or passive chemical restraint systems, such as urea-formalin-based glues, and or sub-sonic or hypersonic sound waves emitted by emitters and which have been successfully tested and demonstrated by the US DOD in experiments with non-lethal defense systems. In yet another example the use of voice and non-voiced sounds can be used to active the systems containing telemetry and emitters contained within or on the garment I have included a sketch, marked as FIG. 5, which I copied from Page 85 of a book by Dr. Forest Mims, III, entitled, 103 Projects for Electronic Experimenters, Published by Tab Books, Inc., Blue Ridge, Pa. This FIG. 5 is an example of a more exotic type of radio communicator wherein light waves are used to carry the signal from the transmitter to the receiver. An example of a more advanced garment utilizing the instant invention would incorporate the tenets of one of my earlier patents, U.S. Pat. No. 5,523,757 incorporated herein as if by entirety, entitled, Signal Dampening and Camouflage System. The emitter can be operated by radio telemetry systems or combinations thereof located on the garment or in the body of the wearer, in the mouth, for example, in a partial or full dental applicance. The emitter can be one or more electro-motive force weapons, such as a rail gun. The switching means of the garment may be located in the mouth of the wearer and is activated by bodily fluid. The switching means of the garment may be contained in or comprise, substantially, face mounted architectures, such as eyeglasses or contact-type lenses coated with electro-reactive substances, such as FeO2 or NiO2, ferric oxide or nickel oxide. The switching means of the garment may include a power source comprising two dissimilar metals, such as copper and silver, supported in a dental architecture within the wearer's dental arcade, which when presented to bodily fluid as the electrolyte, such as saliva, creates a microvoltage, which may be altered by charging capacitors to produce high voltages which can be utilized by such switching means and associated systems for the protection of the wearer.

MODES FOR CARRYING OUT THE INVENTION

Figure 1:
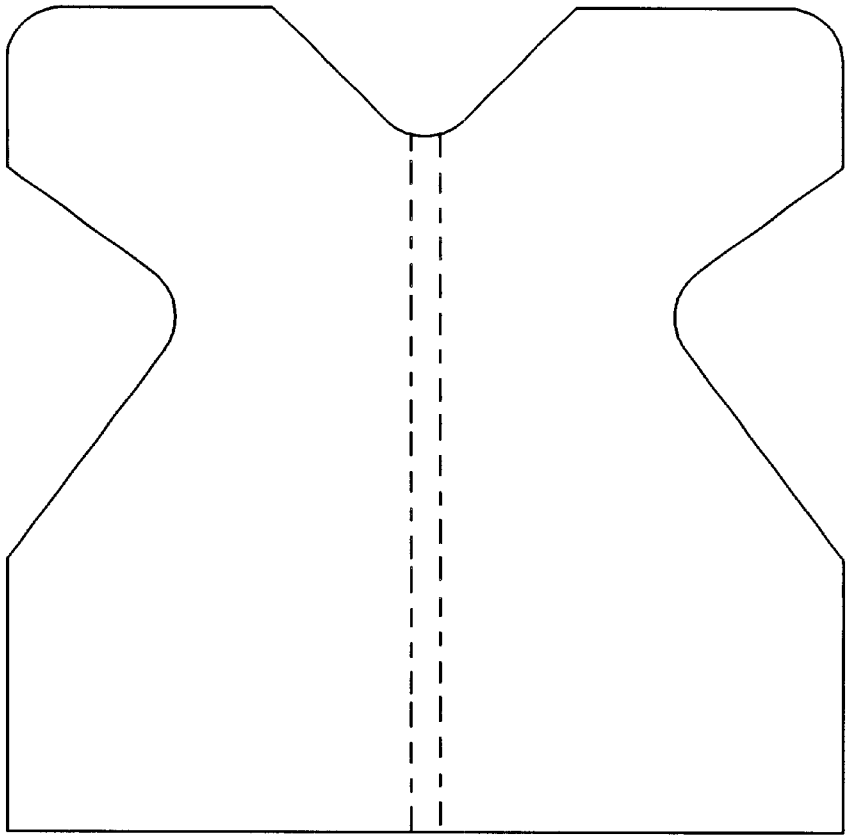
FIG. 1 is a plan view of an example of a garment used in the invention.

FIG. 1 is a schematic drawing of a garment for use in the invention.

Figure 2:
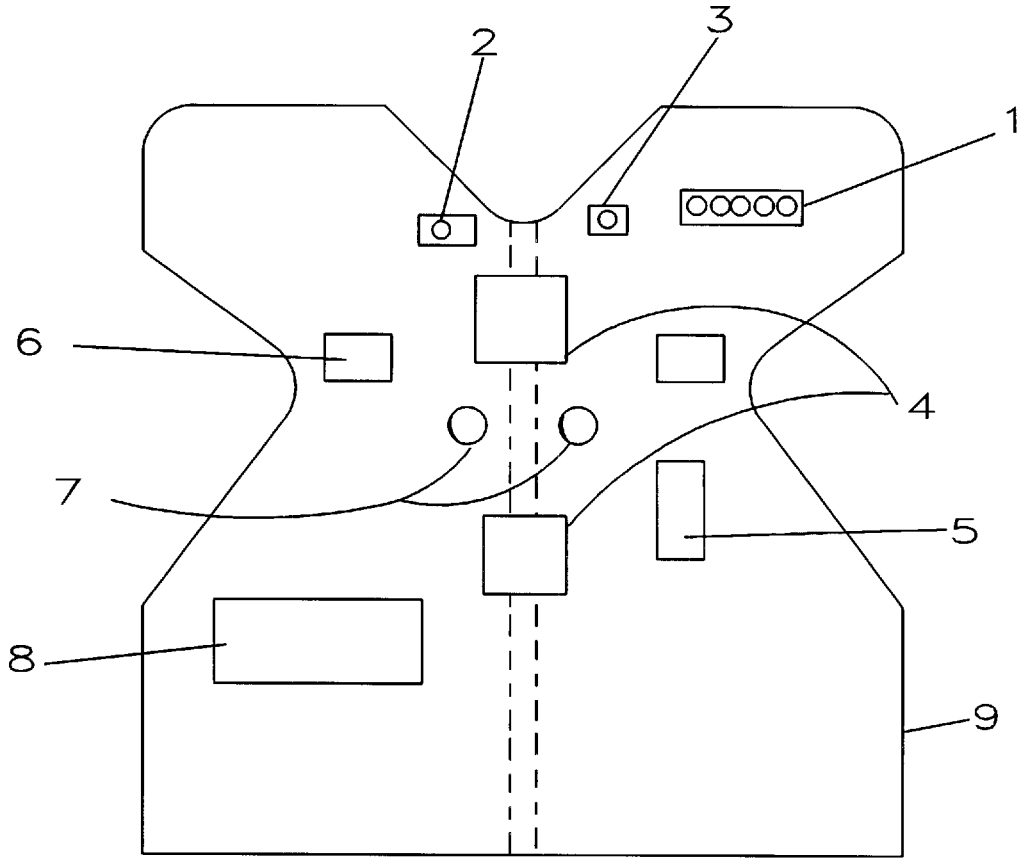
FIG. 2 is a front view of a garment of the invention with mounted components.

FIG. 2 shows the garment 9, with LED array 1, video camera 2, motion sensor 3, emitter ports 4, gas cylinder housing 5, pepper gas housings 6, spray emission nozzles 7, and electronics control panel 8.

Figure 3:
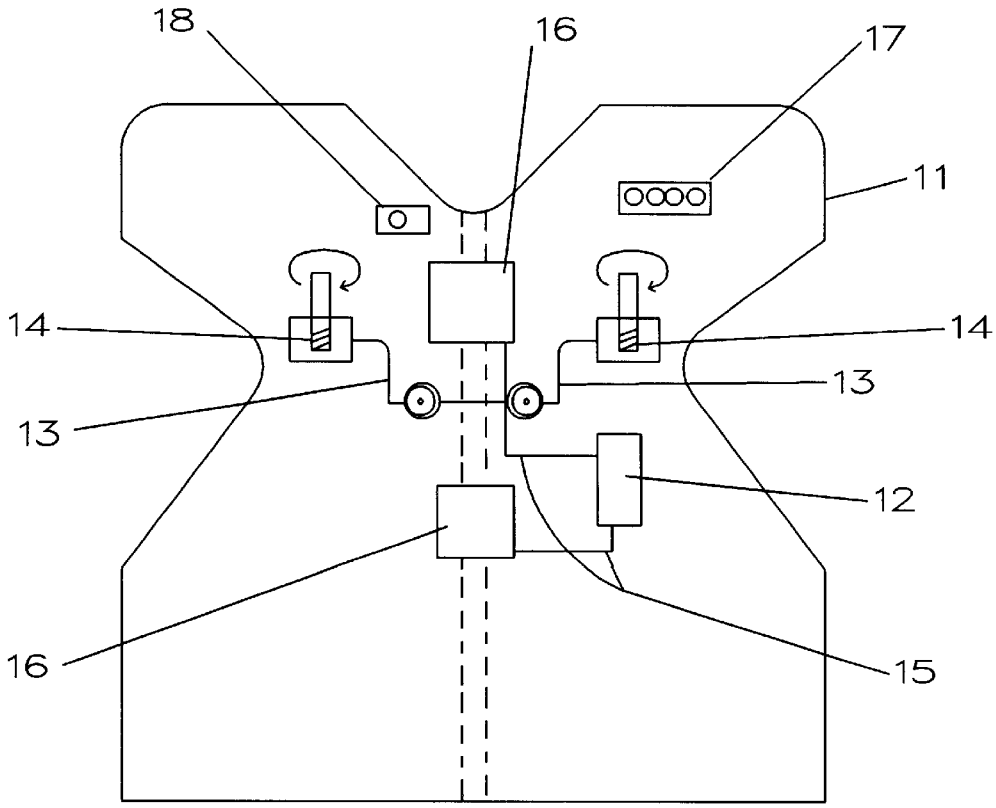
FIG. 3 is a rear view of a garment of the invention with some mounted components.

FIG. 3 shows the garment 11, with gas cylinder 12, Visqueen tubing 13, pepper spray mounting blocks 14, and high-pressure tubing 15, connected to emission platforms 16, LED array 17, and miniature video camera 18.

Figure 4:
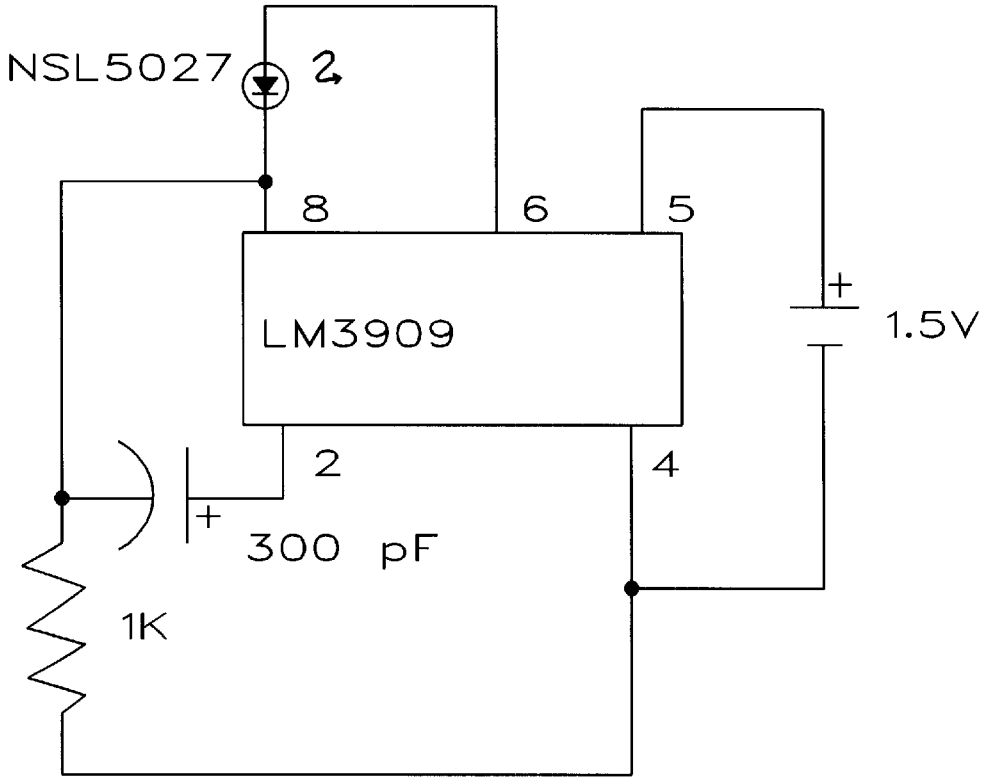
FIG. 4 is a diagram of a circuit used to power a Light Emitting Diode (L.E.D.) array.

FIG. 4 is a simple diagram of a single LED flasher using an LM3909 IC chip.

Figure 5:
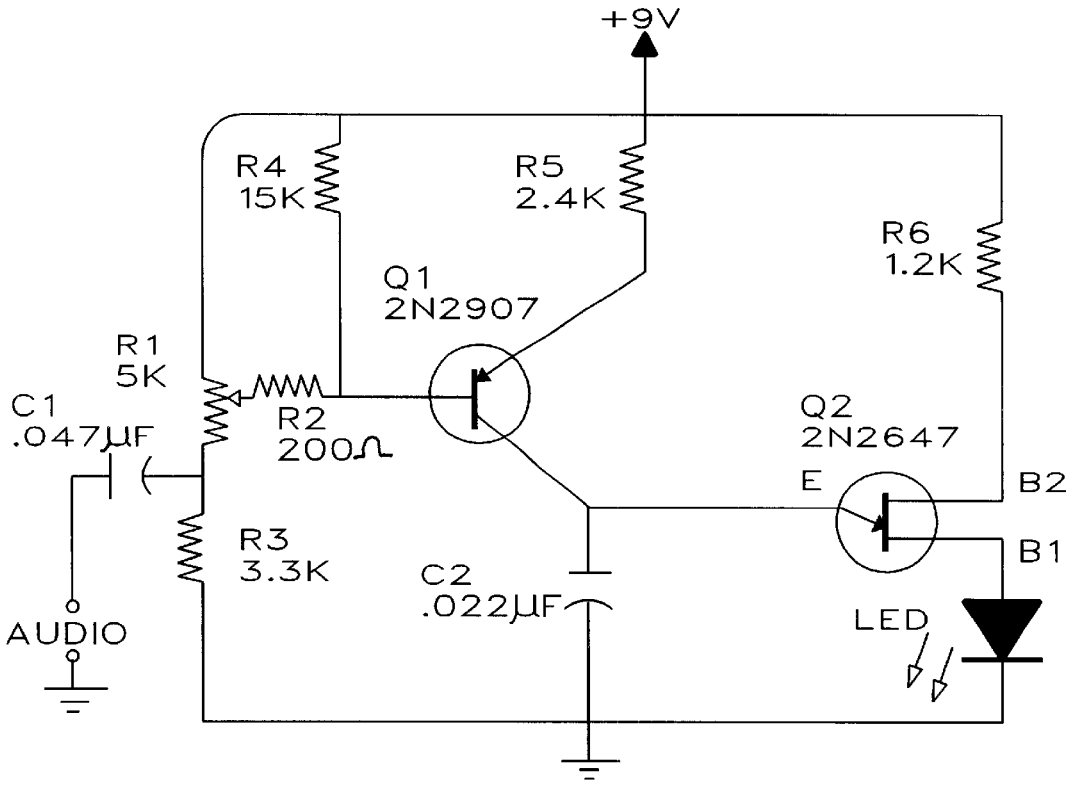
FIG. 5 is a diagram of a light-activated communication circuit.

FIG. 5 is a simple diagram of a light-activated transmitter/receiver circuit.

Figure 6:
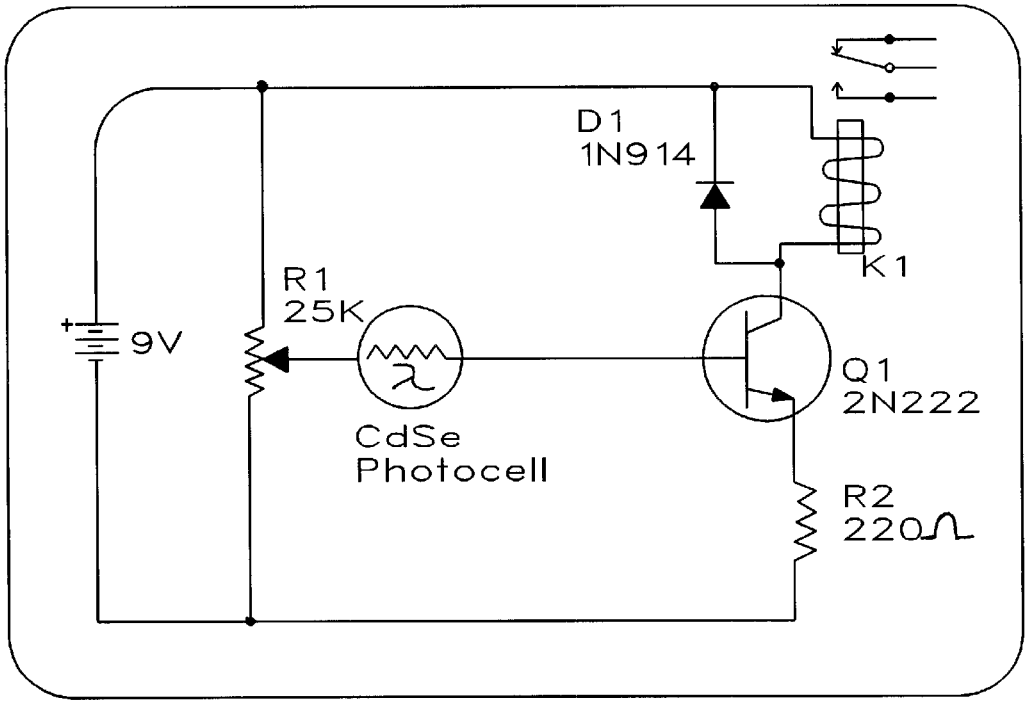
FIG. 6 is a diagram of an electronic circuit used as a light-activated relay switch.

FIG. 6 is a diagram of a simple circuit for a light-activated, motion sensor switch.

In reducing the invention to practice I borrowed pre-existing hardware, such as the launcher mechanism from the Air Taser, the discharge nozzle from the Pepper Spray vessel, and off-the-shelf electronic devices, such as the motion-sensor, the transmitter/receivers, and the wireless video camera system. This was done, primarily, to overcome any potential objections to operability which might be posed by the Examiner. Also, I reasoned that if I could reduce the device to practice with crude, off-the-shelf components, then, a well-funded R&D effort, with a budget provided by a corporate entity or, perhaps, a faction of the government, would easily be capable of refining these larger-than-necessary components and through engineering efforts make new components designed specifically for the purpose of use in the proposed counter-measure garment. I further reasoned that if I could build this device in my humble laboratory and workshop, then someone else who had adequate funding could do a much better job, in terms of machining, electronic integration and design, etc.

Further illustrative of the invention are the following examples:

EXAMPLE 1

In reducing the invention to practice I first obtained a common nylon vest from RAINE POLICE SUPPLY, Indianapolis, Ind., USA for the cost of approximately $20 Dollars. The vest is worn on the external part of the body and covers the chest and back of the wearer. See FIG. 1. The sides are open, moderately, depending upon the cut size of the garment as opposed to the body size of the wearer. For example, if a small-framed person were to wear a vest which has a cut size of XXL, or double X-tra Large, then the sides would be closed by the tie or draw stings. Conversely, if a vest with a cut size of Medium were to be worn by a person with a large body size, for example XXXL, then the sides of the vest would be moderately open. But in both instances the chest and back areas of the wearer would be covered. And the importance of this feature will become more apparent as this treatise develops.

After obtaining the vest, I then created eight patches of like material (nylon) to serve as "pouches" for the purpose of holding discharge nozzles and emission platforms at desired heights and angles on the front (and, alternatively, the back) of the garment. I also obtained approximately ten feet of ¼th inch O.D. VISQUEEN® surgical tubing, which I purchased at Bell Hardware, Brackenridge, Pa. I also purchased a 3 oz can of pressurized "Pepper Spray" or MACE, from the T-N-T Gun & Camp Shop, Tarentum, Pa. I also purchased an M-125K taser device from T-N-T Gunshop which was manufactured by Air Taser, Inc, Scottsdale, Ariz., U.S.A. As set forth in the United States Patent and Trademark Office TESS database available on the Internet, Air Taser is a trademark for goods defined as follows: "Electronic weapons which use compressed gases to launch wire trailing projectiles to incapacitate a large target from a distance." I then purchased a microelectronic motion sensor switch, Catalog #45655-0, from the Radio Shack Store in Natrona Heights, Pa. I also purchased a number of other small electronic components which I thought I would need to reduce the system to practice, specifically, an electronic switching means. These are described in detail below. All of the components were assembled and installed at the various positions on the garment as shown in FIGS. 1 to 3 using various attachment means, such as hot glue, sewing, or use of fastening systems, such as VELCRO® fastening system.

To reduce the invention to practice I obtained two 2 oz. cans of containerized pepper spray, such as that manufactured by the Garrity Company, Groton, Conn. from the T-N-T Gun & Camp Shop referenced above. I then created a channel path and four (4) emission platforms (two in front of garment, two on back of garment) for the discharge nozzles for use with the pepper spray or MACE. I created the "emission platforms" for use with emitters by cutting four (4) wood blocks having a dimension of two inches long by one half inch wide by two inches in height. I made two for the front of the garment and two for the back side of the garment. Into these wooden blocks, which were fashioned from discarded or scrap lumber which I had sitting around my laboratory, I drilled intersecting holes in the center of the block, lengthwise and through the height thereof. Creation of these fenestration's were made using a common wood drill bit with a diameter of 3/16th of an inch. Creation of these permitted insertion of tubing into a secure and sturdy foundation and likewise provided a place into which the nozzles could be placed, thereby making one type of emitter. Futher the wood blocks afforded a convenient and sturdy place to fasten the garment to, where in combination the emitter and emission platforms were held in place. I experimented with several means of fastening the wood blocks, including use of hot glue, Velcro Fastening System, and sewing by hand. Any one of the systems can be used, but I used the hot glue and sewing method in combination, as this made for a very strong mounting of the emitter and emission platforms. These platforms were also used to mount the components of the air taser. Please refer to FIG. 2 for a better understanding of this feature. To mount the emitter and emission platforms I had to make retrofits to the garment. This was accomplished by using a common Tailor's pin to cut the seams on the vest, sufficient to allow placement of the ¼th ".O.D. tubing in and through the body of the garment to each of the 4 individual emission platforms (See FIG. 3 which is a frontal view). I was careful to leave a sufficient amount of tubing in order to connect same to the automatic switching means controller which I built from component electronic parts I purchased from the Tandy Radio Shack Store in Natrona Heights, Pa., and to the electrically-operated valve adjacent to both the 2 oz. bottle of pepper spray or MACE, which serves as the main reservoir. These components were then installed in the garment at the various locations as indicated by drawings 1 to 3.

I acquired an Air Taser Gun from T-N-T Gun & Camp Shop, manufactured by AIR TASER, Inc., Scottsdale, Ariz. USA. As set forth in the U.S. Patent and Trademark Office TESS database available on the Internet, Air Taser is a trademark for goods defined as follows: "Electronic weapons which use compressed gases to launch wire trailing projectiles to incapacitate a large target from a distance." I then disassembled the taser gun and separated the launching ports. I disassembled the air taser into its basic components and used only those parts I needed to mount the emitter into the emission platforms described above. The wood blocks worked well for this purpose, but other material, such as NYLON® could be used and would be better suited by virtue of its durability.

Each of the two emission launching ports was then mounted inside the frontal portion of the vest where I had previously made openings along the seams using the Tailor's pin, so as to place the wiring and leads, in parallel, to the triggering means of the Air Taser. See FIG. 3 for a detailed description of this feature. I then built a simple electronic circuit using an optoisolator and circuit, which I purchased from the Tandy Radio Shack Store in Natrona Heights, Pa., such as described in FIG. 6. This circuit can be activated to enable for automatic operation of the switching means for both the pepper spray/mace and/or the Air Taser emitters and emission platforms. A complete list of electronic parts and components is included for illustrative purposes but should not be considered limiting, as many other types and configurations of electronic circuits could be built and used to accomplish aspects of the invention.

After building the circuits and testing same, I then connected these to a central power port located on the vest (See FIG. 2). I built a simple L.E.D. (light-emitting diode) array using components I purchased at the Tandy Radio Shack Store in Natrona Heights, Pa. Please refer to FIG. 3 for a better understanding of placement and operation of the display. I also located an L.E.D. array on the shoulder plate of the garment, as this is to be activated and flash intermittently, when the systems is activated. This was done as an additional safety feature for both the wearer and the person looking at the wearer. This is for the safety of the Officer wearing the garment and the person whom the officer is engaging. It is assumed that the police officer, after engaging the system, will inform the person he/she is speaking with that he is wearing an interactive defense garment and that a self-defense deterrent system is armed when the LED's are flashing and that the person being engaged should not make any moves to approach the officer without first advising the officer or warning the officer of his/her intent to do so . . . otherwise the motion sensors used to engage the system automatically, will engage the defense system and the deterrents (mace and Air Taser) will be deployed . . . rendering the person engaged temporarily incapacitated. The taser assembly firing switch and the pepper spray assembly release valves may both be controlled independently or simultaneously independently or in combination with the optoisolator or motion sensitive switching means described below. In a second, congruent telemetry system a motion sensor, identical to those commonly found in lamps or other simple electronic circuits can activate one or all of the component emitters, emission platforms components or sub assemblies, or any of the counter-measure or counter-counter-measure devices. For example, the type of motion sensor I used in my experiments operates by sensing a fundamental light source which is ascribed a particular electronic value for which light is present at that particular moment. This is a specific electrical value and the sensor operates over a range of predetermined values. See FIG. 6 for example. The light source corresponds to a frequency or voltage being carried across an array or series of wires comprising an electronic value grid, located in a silicon wafer, commonly known as an "optoisolator". These devices are in widespread and common use in devices ranging from cookie jars to the famous "CLAPPER"® as seen on television commercials. These electronic devices have the ability to recognize the variance of voltages as a function of the amount of light or sounds being imparted onto the electronic grid comprising the elements of the sensor at any given time. These representative components were installed into the garment and were secured using various mounting means, such as use of hot glue, sewing the components in place using a loop and stitch method. For example, to locate the tubing in its desired location for use with sensor-control device I used hot glue to hold the tubing in the basic location. Then, at intervals of approximately every three or four inches, I used a cobbler's awl to create holes through which I placed 40# monofilament fishing line, which is very strong, which I obtained from my fishing tackle box, but which had been purchased from the K-Mart Store in New Kenisngton, Pa., to secure the lines in place and to keep them from shifting. I used this material and process in closing the vest seams once all the components had been installed. The use of monofilament line in holes made with the awl proved to be an ideal method for both closing the seams and because of its physical strength, light weight, color and ease of use, the monofilament line process could be used in future, market-ready devices.

With respect to use of motion sensors, these devices have a set point or operating threshold and operate between a range of voltages. For example, a sensor may be used to operate a switch by permitting a voltage of 2 volts D.C. to drop across the circuit. In this instance the optoisolator, or photo-sensor, has an operating range of 2 to 4 volts D.C. The grid controlling the switch is controlled by resistors which are sensitive to the slightest change in voltage and these values are expressed in terms of Ohms (or resistance). The slightest drop in the resistance value as a result in change of light or sound intensities, from a starting point, causes the circuit controlled by the switching means to be activated, or deactivated depending on desired use. The circuit or switch controlled by this device is gated or activated. The circuit continues to operate for a predetermined time interval previously set in the circuitry of, generally, a 555 timer chip, such as Cat. No. 45884-R, available from Tandy Radio Shack Store Natrona Heights, Pa. In such instances of usage switches of this nature can be used as means of engaging or isolating one circuit from another. In the instant embodiment it can be used to activate the emitter assemblies or telemetry systems or any combinations thereof. An alternate IC chip, such as the one shown in FIG. 4, which I copied from page 504 of The Monster Handbook of IC Circuits, by T R Powers, Published by Tab Books, Inc., Blue Summit, Pa. ISBN #0-8306-0028-0 ACCRA, would work equally as well. I used the 555 chip because of its ease of operation, availability, and minimal cost.

EXAMPLE 2

In a second embodiment I configured an electronic transmitter/receiver in order that a second police officer could control the deterrent systems in the garment via remote control in the event the wearer was not able to active same. I obtained the electronic transmitter/receiver devices, these are manufactured by Motorola Corporation, Midland, Mich., and are designated as models 4-A and 46-C, transmitter and receiver, respectively, from the John B. Smith Company, Clearwater, Fla. for under $30.00 Dollars each. For experimentation purposes I purchased rather inexpensive electronics components, as my research is not funded by any company, government agency or entity, and my R&D budget is conservative. However, these devices have an effective range of less than ¼ of a mile and as such would not be well suited for the intended field applications. In subsequent, market-ready versions I would use electronics devices of a higher quality and with output ranges and receiving ranges greater than 1 mile. or between zero to five miles, with broadcast capabilities between ¼th to 50 watts. In this embodiment one or more remote telemetry systems, for example, in this case, the receiver, is used to remotely control the discharge of the deterrent systems via emitters, such as the Air Taser, Net Cannon, Sound-Bullets, Urea-Foam Glue Spray, Pepper Gas/Spray, or super lubricants, contained in/on the countermeasure garment. For example, a wireless video camera, model J-3T (See FIG. 2) manufactured by SWINTEK, INC., Calabassas, Calif., which I purchased from Damark International, Winnetka, Minn., is deployed on the wearer's vest and a second wireless video camera is located in the officer's police cruiser. The remote camera located on the wearer's garment transmits a video signal to a receiver located in the police cruiser, which also has a second video camera mounted on the vehicle providing for second observation means. Location of both video cameras enables observation of the officer and immediate scene from both the vehicle as well as from the wearer's vantage point. Thus a third observer, located a distance away from the actual scene, but able to monitor same via telemetry downlink, would be able to offer assistance if necessary. Such location allows a third person the ability to observe interaction between the officer and the actor. These video signals are simultaneously transmitted, or downlinked, to a second remote site in a command center where yet another officer may observe the situation. If, for example, the first officer conducting the field stop is attacked during the interaction, the second officer remotely located and observing the interaction via remote video whether located in the vehicle or located miles away at the police station, for example, is able to activate the first officer's deterrent countermeasure systems in the event the first officer is unable to do so on his own behalf. This is another significant aspect of the instant invention. The types of systems, representative of which can be deployed during attack on the wearer include, but are not limited to: Air Taser; Urea/Foam-Glue Emulsion, manufactured by 3 M Corporation of Minneapolis, Minn., or the Net Cannon, Manufactured by Jaycor Corporation of San Diego, Calif., and experimented with by the U.S. Marine R&D Command, Quantico, Va. on May 3–6, 1999 (NTAR Symposium), or the "Sonic Gun", an instrument developed by Bell Laboratories and experimented with by U.S. Army which emits concentrated microwaves which can cause severe stomach ache in persons shot with such microwaves, or other LTL technologies, such as super lubricants, sleeping gas such as "EZ-4", pepper spray balls, or tear gasses mentioned earlier. It should be noted that these citations are representative, only, and any number of different systems could be employed to reduce the invention to practice or accomplish its intended benefits. In building this rudimentary system I used the remote-controlled camera I purchased from DAMARK INTL. to conduct several experiments. Chiefly, I was concerned as to whether or not the system could be mounted on a garment and used effectively. In reducing this aspect of the invention to practice I determined that use of this system was possible and beneficial and a valuable feature of the invention.

EXAMPLE 3

In yet another embodiment it would be possible to mix a chemical-reactive substance, such as bromine chloride, in with a spray or pepper spray to act as a chemical trace marker used in identifying the actor. This type of chemical marker is manufactured by Prabhat Chemical Company, New Delhi, India and is imported into the US in the form of alkyl bromide, a dye intermediate. For more information please see http://www.bicserve.com/htm/pranhat3.htm on the World Wide Web. For example, bromine chloride will fluoresce or "glow" upon presentation to a common Wood's Lamp. This feature would add an additional identification tool to police when gathering evidence for identification and prosecution. For this experiment I obtained a 2 ounce bottle of oleoresin capsicum with a heat factor of two million Scoville Units, from my laboratory stores, which I had obtained in 1996 from my associate company, Bamacal Ban, Inc., Pittsburgh, Pa. For the bromine, I obtained one ounce of DOWNY FABRIC SOFTENER® manufactured by Lever Brothers, Inc. New York, N.Y. from my laundry at my laboratory. This substance contains bromine, in a trace amount, and phosphorous, which will fluoresce under a Wood's Lamp and was an easily accessible and stable source of bromine for use in the experiment. To make the projectiles for use in the emitter/launcher to launch the new marker I fabricated a quantity of microcapsules, having an approximate diameter of 500 micrometers, using the apparatus I described in my U.S. Pat. No. 05,807,724, entitled, Degradation of petroleum hydrocarbons with organisms encapsulated in wax, which issued to me in 1998. I successfully manufactured approximately 4 ounces of the microcapsules for use in the experiment. Upon completion, I loaded the launcher, fired same discharging the contents into a containment cubicle from a distance of approximately 10 feet from the wall to the launcher. The microcapsules impacted with the wall leaving residue which I exposed to the Wood's Lamp. The wall appeared to be speckled, as I had anticipated, and the air was permeated with pungent, aromatic fumes from the release of the oleoresin, thus proving that it would be possible to place a marker device into the launcher system with pepper spray in combination. Thus, I now specify such and claim such components as part of the invention. Another part of the invention is use of microcapsules, or nanocapsules containing markers.

EXAMPLE 4

In yet another embodiment it would be possible to place microscopic-sized identification particles, such as those used in certain brands of gunpowder to identify the manufacturer, into a urea/foam-glue paste and this can be applied to the act during an attempted assault and emitted by the emitters. For example, the microscopic-sized identification particles could be encoded with the police department's identification code and would serve as a most compelling form of evidence for court.

EXAMPLE 5

A further embodiment may include placement of a miniature transmitter on both the garment wearer and delivery of a second miniature transmitter to the body of the actor through ejection via the emitter means exemplified in FIG. 3, said transmitters capable of being detected by means of Global Positioning Satellites, such as GOES 8 and 9 operated by the U.S. Geological Survey, Department of the Interior. Operability of such a proposed system is feasible due to experiments and products developed by Jaycor Manufacturing Systems, San Diego, Calif., which has developed a product called, "The Sticky Stun", which consists of a number of miniature electrical devices which are deployed in the direction of an actor and stick to the clothing and deliver minute electrical shocks to the actor once deployed and attached. This configuration would enable an alternative telemetry system to keep track of both the police officer and the would-be actor and would further aid in maintaining safety of all parties and the general public and is another novel feature of the invention.

EXAMPLE 6

An additional feature of the invention provides for spraying the actor or assailant with a chemical trace marker dyes, such as liquid bromine or alkylbromide dye, which will fluoresce under a common Wood's Lamp and has been known to stand up as evidence in a court of Law. In addition to the aforementioned, a second, discrete LTL system could be delivered to the body of the actor, comprising, for example, miniature stun electrodes suspended in a bonding agent, such as the "sticky-foam", for example and these could be activated either by the wearer of the garment or remotely by an observer who is observing the wearer via remote video signal, with the power for the miniature stun electrodes being generated by RF, radio frequencies, generated by a third system contained in the police cruiser, or by voiced-or non-voiced sounds, a blow to the wearer's body, for example, or a scream, for example, or a predetermined activation word, "HELP !", for example. An example of this type of system is the experimental airplane which is powered by microwave technology, i.e., the microwaves are aimed at the airplane and are used to power a motor on the aircraft. In like manner an actor could be sprayed with miniature shocking electrodes, and a microwave transmitter pointed at the actor would energize the stun electrodes thus disabling or neutralizing the actor. Such could easily be accomplished using an RF Transmitter/Repeater System, ranging in size from 0.25 to 3 meters. It should be mentioned that the above embodiments are illustrative of only several possible uses for the invention, and in that regard the instant description should be considered illustrative rather than limiting and easily accomplished by persons of relative skill in the art.

EXAMPLE 7

In yet another embodiment of the invention, I configured an electronic system which enables the user or wearer, or another person, to activate the defense systems present in the invention. In reducing the invention to practice it became apparent to me that there might be an occasion when the user was unable to activate the system, or in the event the Optosensor failed to engage the defense system, a second person, watching from a remote location, for example, police cars now have video recorders and cameras on board. A telemetry systems could be incorporated into the switching means or remotely-controlled triggering means, and activated by a person watching a remote transmission of a video signal and whereupon seeing that the officer was in trouble, or being assaulted, that person could activate the defense system, or trigger and emitters, from a remote location, thereby saving the officer who was being assaulted and the person perpetrating the assault through employment of less-than-lethal technologies.

I was able to configure a rudimentary system which enabled remote control of the defense systems in the garment using off-the-shelf products, such as the video camera system I purchased from DAMARK, INTL., Winnteka, Minn., and the radio transmitters purchased from the John B. Smith Company, Clearwater, Fla. Although this description describes the means and method of accomplishing this novel aspect of the invention, it should be considered illustrative rather than limiting and easily accomplished by persons of reasonable skill in the art.

Illustrative Component List

1. LM 3909 IC Chip
2. 555 Timer IC Chip
3. LASCAR IC Chip
4. Photosensor
5. Optoisolator
6. FM Radio Transmitter
7. FM Radio Receiver
8. Capacitors
9. Resistors
10. L.E.D.'s

I claim:

1. A garment equipped with an armable emitter, said emitter being positioned on the garment for defending against a potential attacker, further comprising a sensor-driven means for arming the emitter upon sudden movement of a potential attacker.

2. A garment equipped with a fireable emitter, said emitter being positioned on the garment for firing at a potential attacker, further comprising an interactive radio and video telemetry means enabling a supervisor to observe a situation being faced by a wearer of the garment and to fire the emitter for the wearer.

3. A garment equipped with an emitter, said emitter being positioned on the garment for defending against a potential attacker, the emitter comprising:

A. Means for launching wire-trailing projectiles in the direction of an attacker; and further comprising:

B. A second emitter means for firing a marker in the direction of the attacker.

4. A garment equipped with an emitter, said emitter being positioned on the garment for defending against a potential attacker, the emitter comprising means for:

A. launching a net in the direction of the attacker; and

B. utilizing a substance as a means of launching said net.

5. A garment equipped with an emitter, said emitter being positioned on the garment for defending against a potential attacker, the emitter comprising means for:

A. launching a sticky substance in the direction of the attacker; and

B. utilizing a propelling substance as a means of propelling the sticky substance in the direction of the attacker.

6. A garment as claimed in claim 5, wherein the sticky substance comprises a glue.

7. A garment equipped with an emitter, said emitter being positioned on the garment for defending against a potential attacker, the emitter comprising an electronic weapon, said electronic weapon having means for producing energy spectra injurious to human beings.

8. The garment as claimed in claim 7, wherein the spectra are sounds.

9. A garment equipped with an emitter having an identification marker, the emitter being positioned on the garment for delivering the identification marker in the direction of and to the body of an actor.

10. A garment equipped with emitter, where the emitter comprises a marker, wherein the marker is an electronic radio frequency transmitter operating over the entire broadcast spectrum.

11. A method of defending an individual, comprising the steps of wearing by the individual a garment having a weapon, and firing the weapon from the garment in the direction of an attacker, wherein the firing is done by an observer, different from the individual.

12. A method of defending an individual, comprising the steps of wearing by the individual a garment having a weapon, and firing the weapon from the garment in the direction of an attacker, wherein the firing is done automatically for the individual by and through electronic sensing means contained in the garment.

13. A method of defending an individual, comprising the steps of wearing by the individual a garment having a weapon, and firing the weapon from the garment in the direction of an attacker, wherein the firing is done by signal from a location remote to the garment, in combination with means contained in the garment for acting on said signal.

14. A method of defending an individual, comprising the steps of wearing by the individual a garment having a weapon, and firing the weapon from the garment in the direction of an attacker, further comprising the steps of sensing sudden movement by an actor toward the direction of the individual and then placing the weapon in an armed state ready for the step of firing toward the actor as a potential attacker.

15. A method as claimed in claim 14, further comprising the step of sensing closer approach of the actor, before the step of firing the armed weapon.

16. A method of defending an individual, comprising the steps of wearing by the individual a garment having a weapon, and firing the weapon from the garment in the direction of an attacker, further comprising, before the step of firing, the step of sensing a physiological variance of an actor, for the purpose of alerting the individual or an observer to such change.

17. A method of defending an individual, comprising the steps of wearing by the individual a garment having a weapon, and firing the weapon from the garment in the direction of an attacker, further comprising the step of visual monitoring of the individual and an actor by a third party.

18. A method as claimed in claim 17, wherein the firing is done by the third party, based on the visual monitoring.

19. A method of defending an individual, comprising the steps of wearing by the individual a garment having a weapon, and firing the weapon from the garment in the direction of an attacker, further comprising the step of monitoring of the individual and an actor by satellite.

20. A garment equipped with an emitter, said emitter being positioned on the garment for defending against a potential attacker, where said garment is made from composite substances comprising microspheres and the microspheres have a coating reactive to electrical impulses, in order to effect a change of properties of an outside portion of the garment.

21. A garment equipped with an emitter, said emitter being positioned on the garment for defending against a potential attacker, the emitter being operated by sounds produced by a wearer of the garment.

22. A garment equipped with an emitter, said emitter being positioned on the garment for defending against a potential attacker, further comprising a radio telemetry systems means for operating the emitter.

23. A garment equipped with an emitter, said emitter being positioned on the garment for defending against a potential attacker, where said emitter is an elecrto-motive force weapon.

24. A garment, having a signal damping and camouflage means for protecting a wearer by making the wearer unobservable, undetectable, and invisible, both visually and electronically, to an attacker.

25. A garment equipped with a switchable means, in combination with a switching means located in the mouth of a wearer of the garment, the switching means being activatable by bodily fluid.

26. A garment equipped with a switchable means, in combination with a switching means contained in face mounted architectures.

27. A garment equipped with a switchable means, in combination with a switching means including a power source comprising two dissimilar metals supported in a dental architecture within a wearer's dental arcade, which when presented to bodily fluid as the electrolyte creates a microvoltage.

28. A garment as claimed in claim 9, wherein the marker is a transmitter for tracking by Global Positioning Satellite.

29. A garment as claimed in claim 13, wherein the signal is from an orbiting satellite.

* * * * *